United States Patent [19]

Williams

[11] 4,122,762

[45] Oct. 31, 1978

[54] AIR-SLOT SPACER CLIP

[76] Inventor: Arthur C. Williams, 21711 Glenbranch, Spring, Tex. 77373

[21] Appl. No.: 775,387

[22] Filed: Mar. 7, 1977

[51] Int. Cl.[2] ..... G09F 7/18; F24F 13/06

[52] U.S. Cl. ..... 98/40 D; 52/39; 248/343

[58] Field of Search ..... 98/40 D, 40 DL, 114; 248/343, 215; 52/39

[56] References Cited

U.S. PATENT DOCUMENTS

| | | | |
|---|---|---|---|
| D. 19,046 | 4/1889 | Williamson | 248/215 X |
| 1,726,316 | 8/1929 | Saxton | 248/215 |
| 1,924,986 | 8/1933 | Frazier | 52/632 |
| 2,954,954 | 10/1960 | Larson | 248/215 |
| 3,343,310 | 9/1967 | Netz et al. | 98/40 D |
| 3,701,895 | 10/1972 | Sweetser | 98/40 DL |

*Primary Examiner*—William E. Wayner
*Attorney, Agent, or Firm*—Bard & Groves

[57] ABSTRACT

In one exemplary embodiment, a construction clip for rigidly interconnecting and uniformly spacing a pair of ceiling inverted-tee support members defining an air conditioning air-slot through the ceiling is provided. Further, the clip provides support for the air conditioning ducts which carry air from the main air conditioning ducts to the air-slot. The clip, which is preferably formed of a high grade spring steel, includes an elongated body member having at each extremity a pair of legs extending normally upward from the body member and into a generally U-shaped configuration for securely gripping the vertical portion of the inverted-tee support members. The extremities of each leg are inwardly bent to form clasping hook ends for tightly gripping the tee member vertical portion in a sliding relation. Each pair of legs defines a slot therebetween which extends from the body member to the extremities of the legs to enable the clip to be positioned over intersecting tee members.

6 Claims, 4 Drawing Figures

AIR-SLOT SPACER CLIP

BACKGROUND OF THE INVENTION

This invention relates to construction spacer clips for rigidly interconnecting in a spaced relation inverted-tee support members used in the construction of a suspended ceiling. More particularly, the invention relates to a clip for engaging and securely holding a pair of inverted-tee members positioned in spaced relation to form an air-slot through the ceiling and for receiving and supporting an air conditioning terminal (or troffer) used to carry conditioned air from the main air conditioning duct to the air-slot.

It has been common practice in commercial building construction to utilize a suspended ceiling (sometimes known as a soffit-type ceiling). The ceiling is constructed of a plurality of horizontally suspended inverted-tee support members intersecting to form a grid system for supporting ceiling tiles. The space formed between the soffit ceiling and the permanent ceiling or upper floor of a structure is generally utilized for heating and ventillating ducts in order to provide conditioned air from a central source to various areas within the building, with the ducts extending from a central duct to a troffer having an air discharge opening.

The troffers are generally installed so that the discharge opening abuts an air-slot formed through the soffit ceiling. Such installation requires that the troffer and associated ducting be secured within the soffit area.

It has become the practice to mount the troffers on the frame members of the suspended ceiling. However, such frame members are generally made of lightweight, relatively weak material that may readily be twisted or otherwise distorted by the heavy load of the troffer. Thus, in installations where the troffer is of a narrow design and only engages two parallel tee members, the heavy load imposed thereon may cause such members to twist, or in severe cases, to suffer complete failure.

Various attempts have been made to overcome the aforesaid problem. One such attempt is disclosed in U.S. Pat. No. 3,606,224, and provides a bracket member suitably joined to the air conditioning troffer, such as by rivets for example. The bracket member then extends outward to engage the vertical portion of the inverted-tee members.

Although the above-mentioned bracket provides relative stability to the tee members and, in addition, acts to distribute the load more evenly across the tee members, the construction of the bracket is such that it must be positioned within an area defined by intersecting tee members. Thus, while the bracket is designed for sliding along the tee members, the restriction to a particular square of the ceiling grid reduces the amount of relative movement which may be used to position the air conditioning duct and associated troffer. The disadvantages of the prior art, especially the aforementioned U.S. patent, are overcome with the present invention and a novel spacing clip is provided which allows air conditioning ducts and associated troffers to be positioned where they are required, including positioning the troffer across intersecting tee members.

SUMMARY OF THE INVENTION

This invention is for an improved suspended ceiling construction spacer clip for rigidly interconnecting and uniformly spacing a pair of inverted-tee shaped bars, such as is used with a soffit-type ceiling, to define a air conditioning slot therethrough. In addition, the spacer clips provide a support for the air conditioning troffers and ducts that carry the air from the main air conditioning units to the air-slot. The clip includes a body member having a length preselected to cooperate with the desired air-slot width and has vertical legs disposed on each end of the base. It preferably includes a pair of legs on each end of the base separated by a space, with the legs generally U-shaped and having inwardly bent clasping hook ends.

The U-shaped legs of the spacer bar are inserted over the vertical portion of the inverted-tee ceiling support members to engage the tee members in a rigid, spaced relation. The clips are slidable along the tee members to a predetermined location for receiving and supporting the discharge end of a troffer positioned with respect to an air-slot. The slots formed between the upright legs allow the spacer clip to straddle intersecting tee members, thus allowing the air conditioning troffer to be positioned such that the opening formed therein communicates with the corresponding air-slot.

Accordingly, it is a feature of the present invention to provide a spacer clip for rigidly interconnecting and uniformly spacing a pair of inverted-tee members to define an air-slot in a ceiling.

Another feature of the present invention is to provide a spacer clip for supporting air conditioning troffers used to supply conditioned air through the air-slots.

Still another feature of the present invention is to provide a spacer clip positionable to a desired location along the air-slot, including positioning the clip at junctions formed by intersecting tee members.

These and other features and advantages of the present invention will become apparent from the following detailed description wherein reference is made to the figures in the accompanying drawings.

IN THE DRAWINGS

FIG. 4 is a perspective view of a pair of the spacer clips of the present invention engaging a pair of inverted-tee members and further illustrating the use of the spacer clip at a tee member intersection point.

DETAILED DESCRIPTION OF THE PREFERRED EMBODMENT

Figure 1:
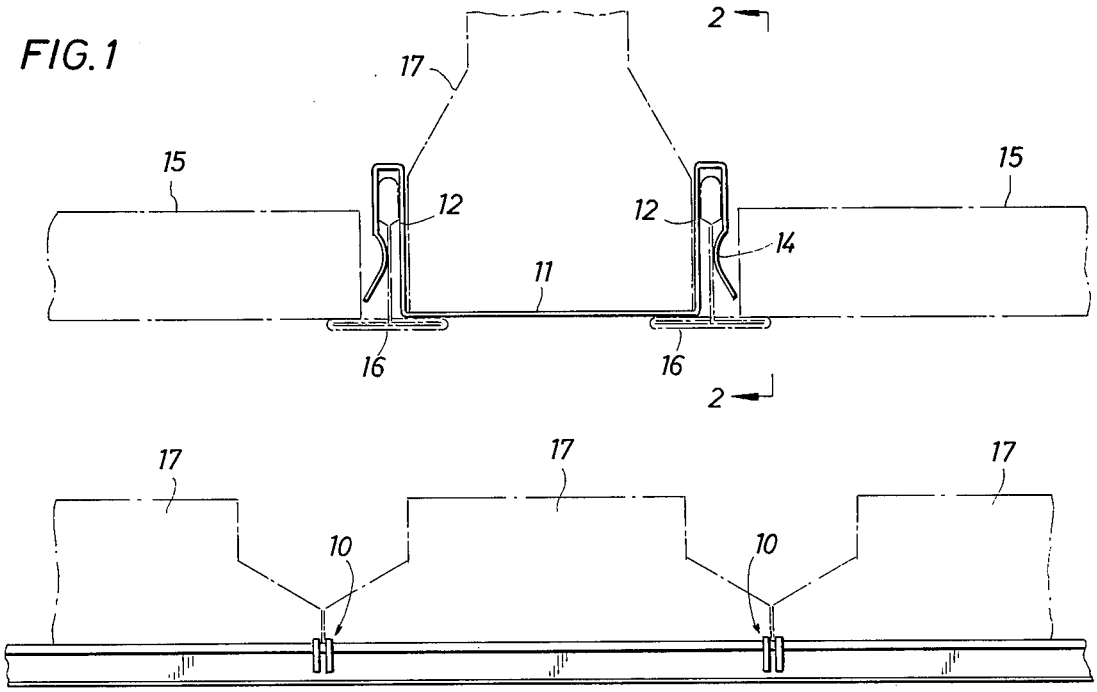
FIG. 1 is a vertical, cross-sectional view of an air-slot spacer clip according to the invention shown interconnecting and spacing a pair of inverted-tee members and supporting an air conditioning duct.
Figure 3:
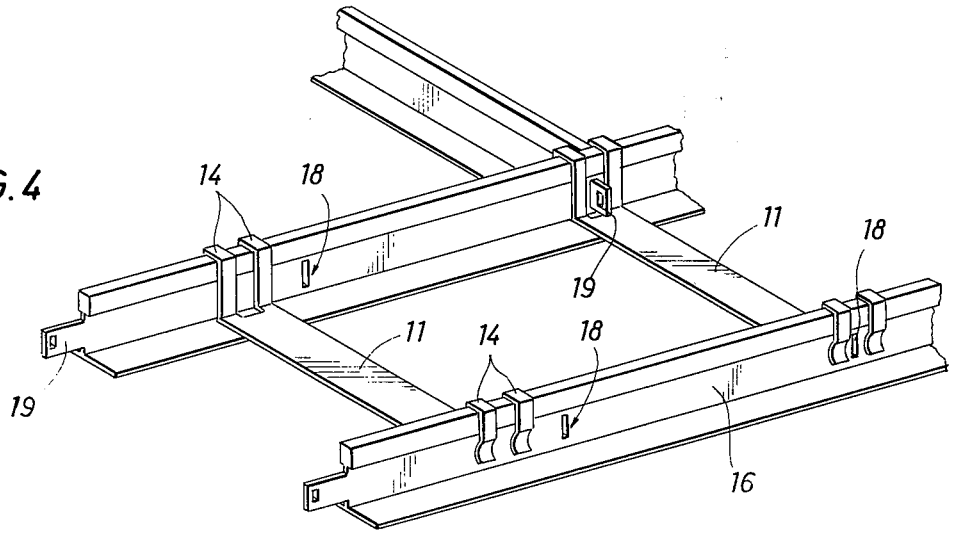
FIG. 3 is a perspective view of the air-slot spacer clip according to the present invention.

Referring now to FIG. 1, the preferred embodiment of the air-slot spacer clip according to this invention is depicted being used for its intended purpose. Clip 10 is preferably formed from spring steel in the U-shaped configuration more clearly shown in FIG. 3 and comprises a body member 11 having a pair of legs 12 extending from each opposing end of body member 11 normal to the surface defined by body member 11.

Body member 11 comprises a flat strip having a longitudinal dimension predetermined by the spacing between the vertical members of a pair of inverted-tee members which have been positioned in spaced relation to define an air-slot. The width of body member 11 may be conveniently preselected to provide for receiving and supporting an air conditioning duct terminal 17 (also known as a troffer).

Legs 12 extend outward from and normal to the longitudinal dimension of body member 11 and are formed in a U-shape with the free extremities of legs 12 positioned outwardly from body member 11. The pair of legs 12 disposed on each end of body member 11 are dimensioned and positioned to define a slot 13 which can extend from a location on body member 11 adjacent its extremity to the free extremities of legs 12. The end of slot 13 adjacent body member 11 is positioned such that slot 13 will be in registration with a rectangular slot 18 formed in the vertical portion of the member 16, as will be hereinafter described. Preferably, each leg 12 includes an arcuate portion adjacent the free extremity which is formed by curving a portion of the leg 12 adjacent the free extremity inwardly toward the body member 11 in order to form a clasp hook end 14 on the leg 12.

Referring again to FIG. 1, there is shown a portion of a suspended or soffit-type ceiling of the type generally used in modern office buildings. The ceiling tiles 15 which form the ceiling are shown supported on the flanges of inverted-tee members 16. As depicted, a pair of inverted-tee members 16 have been placed in parallel, spaced relation to define an air slot through the ceiling.

The U-shaped legs 12 are shown inserted in sliding relation over the vertical portion of the inverted-tee members 12 so as to position body member 11 in abutment with the flanges of the inverted-tee members 16. When clip 10 has been attached to the inverted-tee members 16, clasp hook end 14 grips the vertical portion of the tee members 16 so that clip 10 rigidly interconnects and uniformly spaces the tee members forming the air slot.

Figure 2:
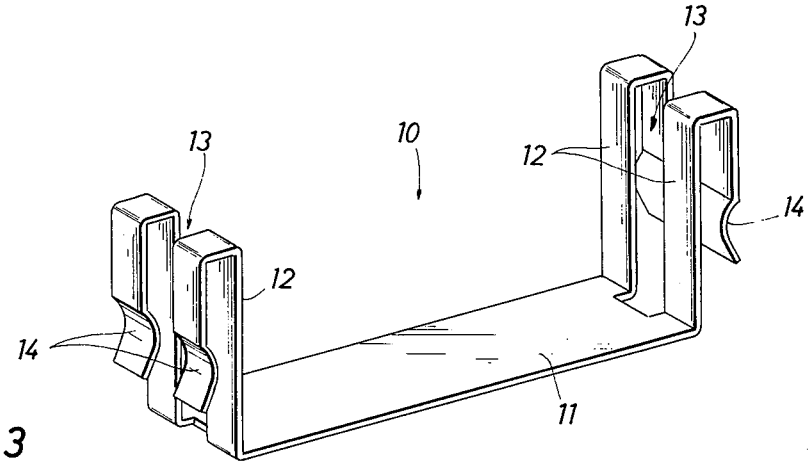
FIG. 2 is an end view of a pair of spacer clips of the present invention implaced on an inverted-tee member and supporting the extremities of an air conditioning duct according to the present invention.

Referring also to FIG. 2, an air conditioning duct terminal (or troffer) 17 is shown positioned so that the discharge opening formed in the troffer 17 communicates with the air slot. The discharge end of the troffer is received on the tee member flanges and on body member 11 with clip 10 equalizing the load produced by the troffer onto the vertical portion of the tee members 16 and preventing twisting or deformation of the tee members 16.

Referring now to FIG. 4, there is shown a pair of parallel, spaced inverted-tee members defining an air-slot as has been above-described. Additionally, there is shown a third inverted-tee member perpendicularly intersecting one of the parallel tee members in a manner commonly used to form the square support grid for receiving the ceiling tiles forming the soffit ceiling. Each inverted-tee member 16 has a plurality of rectangular slots 18 which are formed in the vertical portion of the tee member 16 at preselected locations. Further, tab 19 is formed on each extremity of the tee member 16. During construction of the supporting grid, tab 19 is inserted through a tee member slot 18 to form an intersection with a portion of tab 19 extending beyond slot 18 and the vertical portion of the intersected tee member. The intersecting tee member is then secured to the intersected tee member 16 in any suitable manner, such as bending tab 19 to a position against the intersected tee member 16.

During installation of the soffit ceiling and the air conditioning ducting, it may be necessary to position adjacent to a tee member intersection. The slot 13 is provided to allow clip 10 to be positioned with legs 12 on opposite sides of the portion of tab 19 which extends past the vertical portion of the intersected tee member 16. Tab 19 may then be bent as above-described to accommodate the discharge opening of troffer 17.

Variations and modifications may obviously be made in the structure herein described without departing from the present invention. Accordingly, it should be clearly understood that the form of the invention herein described and shown in the figures of the accompanying drawings is illustrative only and is not intended to limit the scope of the invention.

What is claimed is:

1. An interconnected ceiling structure for a building having an air-slot therein for the introduction therethrough of conditioned air, comprising:

a plurality of spaced, inverted-tee support members, each having a flange portion and a vertical portion and supported in said building, a plurality of ceiling tiles adapted for supporting placement between said inverted-tee support members for forming a building ceiling, at leat one inverted-tee support member having a flange positioned adjacent to and spaced apart from a preselected one of said plurality of spaced apart inverted-tee support members supported in said building for defining an air-slot therebetween in said ceiling for the introduction therethrough of conditioned air, an air conditioning troffer defining a discharge port corresponding in size and shape to said air-slot defined in said ceiling, and a plurality of spacing clips attachable at each extremity to the vertical portion of one of said preselected spaced inverted-tee support members for rigidly maintaining said spaced apart relation therebetween and for receiving and supporting said discharge port of said air conditioning troffer in fixed relation to said ceiling, each spacing clip comprising a central body member, a pair of leg members depending from opposing ends of said body member, each of said leg members defining a slot sized to receive an intersecting inverted-tee support member therein and being a generally inverted U-shape for engaging said vertical portion of an adjacent inverted-tee support member and positioning said body member in abutting engagement with said flanges of said tee support members, and means located on said leg members for securely gripping said vertical portion of said inverted-tee support members.

2. The structure described in claim 1 wherein said gripping means comprise an inwardly bent clasping hook end formed in each said leg and adjacent the free extremity thereof.

3. The structure described in claim 2 and further including forming said plurality of spacing clips of spring steel.

4. In an interconnected suspended ceiling structure for buildings, including a plurality of spaced inverted-tee support members suspended in said building for supporting ceiling tiles therebetween to form a ceiling, and at least one additional inverted-tee support member positioned in parallel spaced relation to a preselected one of said plurality of spaced inverted-tee members to define an air-slot dimensioned to receive the discharge end of an air conditioning troffer, an improved spacer and support clip in combination with said preselected tee member, said additional tee member and said troffer, said improved clip comprising:

a generally U-shaped member having a central body portion, a pair of leg members depending from opposing ends of said body member, each of said leg members defining a slot sized to receive an intersecting inverted-tee support member therein and being a generally inverted U-shape for engaging said vertical portion of an adjacent inverted-tee support member and positioning said body member in abutting engagement with said flanges of said tee support members, and means located on said legs for securely gripping the vertical portion of said tee members.

5. The structure described in claim 4 wherein said gripping means comprise an inwardly bent clasping hook end formed in each said leg and adjacent the free extremity thereof.

6. The structure described in claim 5 and further including forming said generally U-shaped member of spring steel.

* * * * *